United States Patent [19]

Kanno et al.

[11] Patent Number: 4,656,964

[45] Date of Patent: Apr. 14, 1987

[54] DEVELOPING DEVICE

[75] Inventors: Fuchio Kanno, Yokohama; Kazuo Kobayashi, Kawasaki; Koji Sakamoto; Toshio Kaneko, both of Tokyo; Wataru Yasuda, Yokohama, all of Japan

[73] Assignee: Ricoh Company, Ltd., Tokyo, Japan

[21] Appl. No.: 565,273

[22] Filed: Dec. 27, 1983

[30] Foreign Application Priority Data

Dec. 27, 1982 [JP] Japan ..... 57-226631

[51] Int. Cl.[4] ..... G03G 15/08

[52] U.S. Cl. ..... 118/648; 118/651; 118/653; 355/3 DD

[58] Field of Search ..... 118/653, 657, 648, 651; 355/3 DD

[56] References Cited

U.S. PATENT DOCUMENTS 3,003,462 10/1961 Streich, Sr. ..... 118/657

*Primary Examiner*—Evan K. Lawrence

*Attorney, Agent, or Firm*—Oblon, Fisher, Spivak, McClelland & Maier

[57] ABSTRACT

A device for developing an electrostatic latent image formed on a photosensitive member includes a composite sleeve which is comprised of a cylindrical support, a dielectric layer formed on the support and a plurality of fine magnets serving as floating electrodes embedded in the dielectric layer and which is driven to rotate to carry magnetic toner as magnetically attracted to its outer peripheral surface.

15 Claims, 8 Drawing Figures

DEVELOPING DEVICE

BACKGROUND OF THE INVENTION

1. Field of the Invention

This invention generally relates to a device for developing an electrostatic latent image by applying a single component developer thereto, and particularly to a developing device suitable for use in imaging machines such as electrophotographic copiers and electrostatic recording machines for developing an electrostatic latent image by applying magnetic toner thereto in the form a thin film.

2. Description of the Prior Art

In developing an electrostatic latent image formed on the surface of a photosensitive member in the form of a belt or drum which is being driven to travel along a predetermined path by applying magnetic toner thereto, the magnetic toner is first formed into a thin film on the outer peripheral surface of a developing sleeve, which is also being driven to rotate, while being charged to a predetermined polarity and then the thin film of charged magnetic toner is applied to the latent image at a developing region where the surface of the photosensitive member comes closer to or into contact with the surface of the developing sleeve on which the thin film of charged toner is formed. In order to keep the magnetic toner magnetically attracted to the outer peripheral surface of the developing sleeve, use is typically made of a columnar magnet disposed inside of the developing sleeve. Thus, the magnetic toner is transported along a circular path as magnetically attracted to the outer peripheral surface of the sleeve while the sleeve is being driven to rotate, and the magnetic toner on the sleeve is selectively transferred to the electrostatic latent image formed on the photosensitive member electrostatically by overcoming the magnetic attractive force.

Use of such a columnar magnet as disposed inside of the developing sleeve limits miniaturization of the developing device and tends to make the entire device heavier in weight. Particularly, if a relatively high magnetic attractive force is desired at the surface of the developing sleeve, the magnet tends to become larger thereby making the entire device larger in size and heavier in weight.

In developing an electrostatic latent image using a single-component developer, difficulty is often encountered in attaining the so-called edge effect. FIG. 1 is a graph showing ideal developing characteristics normally desired for a developing device for developing an electrostatic latent image, in which the abscissa is taken for the density of an original image and the ordinate is taken for the density of a copy image which is reproduced from the original image. In FIG. 1, the solid line A indicates an ideal developing characteristic for an area image such as a picture abundant in gray-scale representation and the dotted line B indicates an ideal developing characteristic for a line image such as alphanumeric characters. The solid line curve A has a slope of approximately 45° indicating that, in the case of an area image, a copy image substantially corresponds in image density to an original image; whereas, the dotted line curve B has a steeper slope, indicating that, in the case of a line image, the image density of a copy image is increased especially for an original image having a lower image density. This is based on the fact that, in the case of a line image, it is normally desired to obtain a copy image of increased image density even if its original image is rather lower in image density because a copy image of increased image density is easy to read.

In developing an electrostatic latent image with the use of the conventional two-component developer comprising toner particles and iron carrier beads, the carrier beads help obtain the above-described edge effect so that a copy image of increased density may be obtained in the case where the original is a line image as indicated by the dotted line B in FIG. 1. However, in the case of using the so-called single component developer, or magnetic toner, to develop an electrostatic latent image, such an edge effect cannot be obtained sufficiently because of absence of the iron carrier beads. Accordingly, in the case of a line image, a copy image tends to stay low in density if its original image is low in density.

SUMMARY OF THE INVENTION

It is therefore a primary object of the present invention to obviate the above-described disadvantages of the prior art and to provide an improved device for developing an electrostatic latent image Another object of the present invention is to provide a developing device which may be made compact in size and light in weight.

A further object of the present invention is to provide a developing device capable of attaining the edge effect sufficiently.

A still further object of the present invention is to provide a developing device which is simple in structure and thus easy and inexpensive to make.

A still further object of the present invention is to provide a developing device which is particularly suited for use with magnetic toner.

A still further object of the present invention is to provide a developing device suitable for use in an imaging machine such as an electrophotographic copier and electrostatic recording machine.

Other objects, advantages and novel features of the present invention will become apparent from the following detailed description of the invention when considered in conjunction with the accompanying drawings.

DESCRIPTION OF THE PREFERRED EMBODIMENTS

Figure 2:
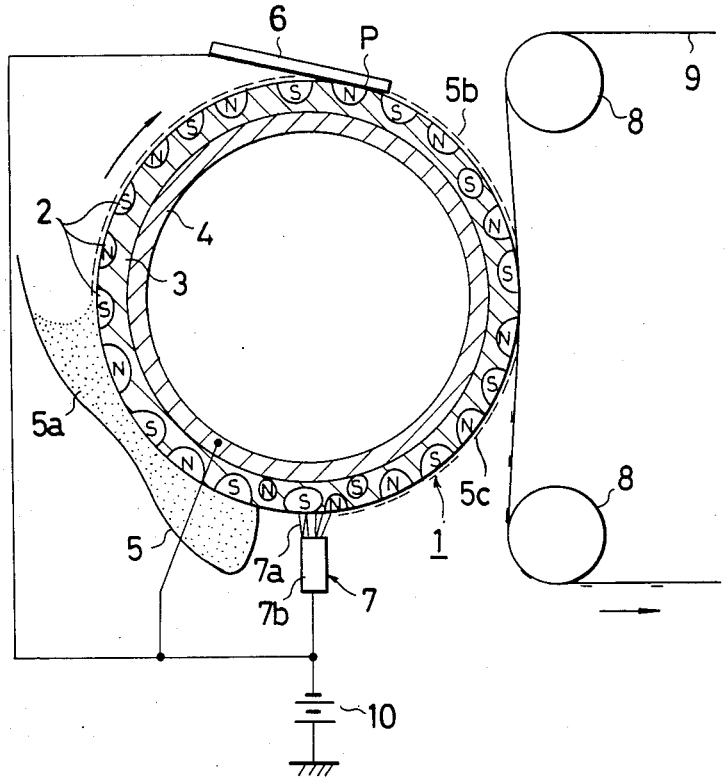
FIG. 2 is a schematic illustration showing the developing device employing magnetic toner constructed in accordance with one embodiment of the present invention.

Now, with reference to the accompanying drawings, the present invention will be described in detail by way of embodiments. FIG. 2 shows a developing device constructed as a component of electrophotographic copying machine in accordance with one embodiment of the present invention. As shown, the developing device of the present invention is provided to be in rolling contact with a photosensitive member 9 in the form of an endless belt, which is extended around appropriate rollers 8, 8 and driven to travel in the direction indicated by the arrow. The photosensitive member 9, for example, includes an endless belt-shaped support of an electrically conductive material and a photoconductive layer formed on the outer surface of the support. Although not shown specifically, it should be understood that various image forming means, such as a charging device and an image exposure device, well known to those skilled in the field of electrophotography are disposed along the travelling path of the photosensitive belt 9, so that an electrostatic latent image is formed on the outer surface of the belt 9 before it enters a developing region which is defined as a region where toner is applied to the electrostatic latent image on the belt from the developing device.

The developing device includes a developing sleeve 1 as a means for transporting toner along a desired path, which is rotatably supported and driven to rotate at constant speed in a predetermined direction, clockwise in the illustrated embodiment. The sleeve 1 of FIG. 2 is in rolling contact with the imaging surface of the photosensitive belt 9 and the sleeve 1 and the belt 9 move in the same direction at the line of contact. In the illustrated embodiment, the developing sleeve 1 includes a cylindrical support 4 of an electrically conductive material, a dielectric layer 3 of an electrically insulating material formed on the outer peripheral surface of the cylindrical support 4 and a plurality of fine permanent magnet particles (fine magnets) 2 of an electrically conductive material embedded in the dielectric layer 3 in dispersion isolated from one another and from the support 4. The detailed structure of this composite sleeve 1 is shown in cross-section in FIG. 3. The magnet particles 2 are electrically conductive and thus they also serve as floating electrodes. Accordingly, the magnet particles 2 are preferably provided closer to the outer peripheral surface of the dielectric layer 3 as partly exposed at the surface.

Figure 3:
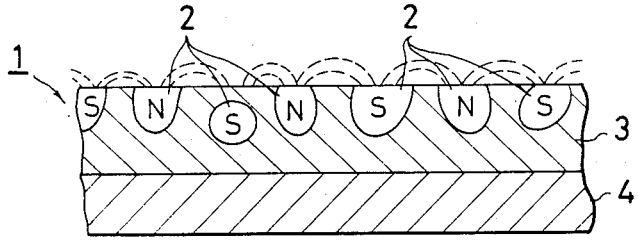
FIGS. 3 through 7 are cross-sectional views perpendicular to the rotational axis of the developing sleeve showing several structures of the sleeve which may be advantageously applied to the developing device of the present invention.
Figure 4:
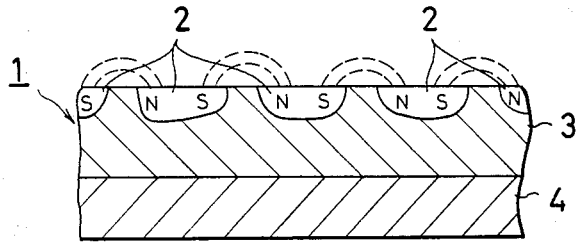
Figure 5:
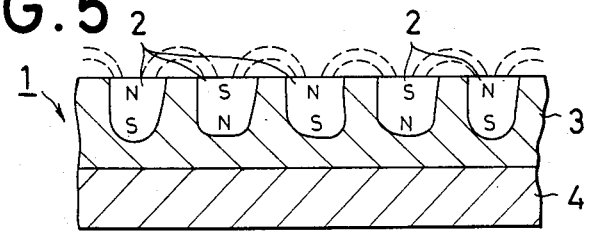

In the embodiment shown in FIGS. 2 and 3, the magnet particles 2 are arranged such that their magnetic dipoles are aligned in parallel with the rotational axis of the sleeve 1 and thus perpendicular to the plane of the drawing. FIG. 4 shows an alternative structure in which the magnet particles 2 are arranged with their magnetic dipoles are aligned circumferentially or in the direction perpendicular to the rotatitional axis of the sleeve 1. FIG. 5 shows a further alternative in which the magnet particles 2 are arranged such that the magnetic dipoles of each magnet particle 2 are aligned substantially perpendicular to the outer peripheral surface of the sleeve 1. It should thus be understood that the orientation of the magnet particles 2 may be selected arbitrarily as desired and it should not be limited to the particular illustrated example. However, the spacing between the adjacent magnet particles 2 must be set such that the magnetic field formed between the adjacent magnet particles 2 is capable of forming a film of toner having a desired thickness and charge as magnetically attracted to the outer peripheral surface of the sleeve 1. It is to be noted that the thickness of such a thin film of toner formed on the sleeve 1 as magnetically attracted thereto is approximately inversely proportional to the closeness between the adjacent magnet particles 2 provided in the dielectric layer 3. Furthermore, the electrically conductive support 4 of sleeve 1 is connected to a negative bias source 10 in the embodiment shown in FIG. 2.

As shown in FIG. 2, a toner hopper 5 storing therein a quantity of magnetic toner 5*a* is disposed adjacent to the outer peripheral surface of the sleeve 1 thereby supplying the toner 5*a* to the sleeve 1. Downstream of the hopper 5 and upstream of the developing region is disposed a pressure blade 6 in pressure contact with the outer peripheral surface of the sleeve 1. The pressure blade 6 is preferably comprised of a magnetic material having sufficient resiliency, and, in this case, the blade 6 is preferably provided with its one end pivotally supported to a stationary object such as a machine housing with the other free end pressed against the outer peripheral surface of the sleeve 1 as magnetically attracted thereto. On the other hand, the pressure blade 6 may also be provided such that its free end becomes pressed against the outer peripheral surface of the sleeve 1 when securely mounted in position, and, in this case, the blade may be made of any desired material. However, the former case is preferable because the blade 6 is provided with a self-adjusting function, thereby preventing undesired excessive force from being applied to the sleeve 1.

The blade 6 in the embodiment of FIG. 2 is in a forward arrangement and thus its free end is pointed in the direction of movement of the sleeve at the point of contact. The toner 5*a* carried on the sleeve as magnetically attracted thereto become pressed between the sleeve 1 and the blade 6 so that the toner 5*a* is formed into a thin film 5*b* of a predetermined thickness while being charged to a predetermined polarity. In the case where the toner 5*a* may be triboelectrically charged sufficiently due to the friction with the surface of the sleeve 1 and a thin film of desired thickness may be formed on the sleeve 1 as passing through the hopper 5, the pressure blade 6 may be discarded. On the other hand, if the pressure blade 6 is comprised of a magnetic material having a relatively high saturation magnetic flux density, the blade 6 may be set in a high frequency vibration as the small scale magnetic field formed at the surface of the sleeve 1 passes through the blade 6, which contributes to insure the formation of a desired thin film of toner and to prevent clogging or stagnation of toner at the contact between the sleeve 1 and the blade 6. Similarly with the cylindrical support 4, the pressure blade 6 is also connected to the negative bias source 10 so that they are maintained at the same potential.

Downstream of the developing region and upstream of the hopper 5 is disposed a discharging brush 7 of an electrically conductive material. The brush 7 includes electrically conductive fibers 7*a* and an electrically conductive base 7*b* to which the fibers 7*a* are fixedly planted, and the brush 7 is disposed with the tip ends of the fibers 7*a* lightly in contact with the outer peripheral surface of the sleeve 1. The brush 7 is also connected to the negative bias source 10 to be maintained at the same electrical potential as those of the support 4 and the blade 6. The brush 7 may also be provided with its tip ends spaced apart from the sleeve 1, if desired. With the provision of the brush 7, any charge remaining on the sleeve 1, particularly in the magnet particles 2, may be removed, thereby preventing a phantom image from being formed in subsequent cycles.

In operation, as the developing sleeve 1 is driven to rotate clockwise, the toner 5*a* is supplied to the outer peripheral surface of the sleeve 1 from the hopper 5 as magnetically attracted thereto by the magnet particles 2 provided as embedded in the sleeve 1. The toner 5*a* thus attracted to the sleeve 1 is transported along a circular path defined by the circumference of the sleeve 1 as the sleeve 1 is further driven to rotate so that the toner 5*a* attracted to the sleeve 1 comes to a film thickness regulating section P where the toner 5*a* becomes pressed between the sleeve 1 and the blade 6. Thus, as the toner 5*a* is transported past the section P, it is triboelectrically charged to a predetermined polarity and formed into a thin film of desired thickness. It is to be noted that as the toner 5*a* becomes charged, the sleeve 1 becomes also charged oppositely with the charge mainly retained by the magnet particles 2 also serving as floating electrodes.

Figure 1:
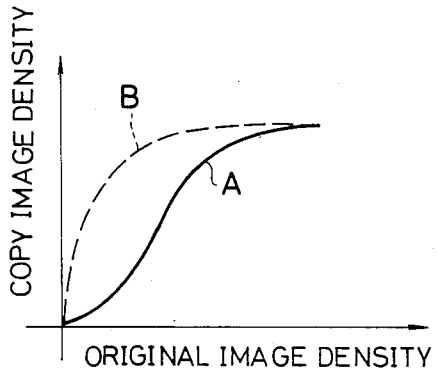
FIG. 1 is a graph showing the ideal developing characteristics depending upon the kind of an original image whether it is an area image such as a picture or a line image such as a alphanumeric character.

A further rotation of the sleeve 1 brings the thin film 5*b* of charged toner to the developing region where the sleeve 1 is in rolling contact with the belt 9, so that the thin film 5*b* of charged toner is applied to the electrostatic latent image formed on the belt 9. In the case where the latent image is formed by the charge opposite in polarity to the charge of the thin film 5*b*, the toner is selectively transferred to the latent image on the belt 9 electrostatically overcoming the attractive force of the magnet particles 2 thereby having the latent image developed to convert the latent image into a visible toner image. In this instance, since the sleeve 1 of FIG. 1 includes a plurality of dispersely provided magnet particles 2 also serving as floating electrodes, these particles 2 function substantially as the iron carrier beads in the conventional two-component developer so that the ideal developing characteristics shown in FIG. 1 may be attained. That is, the number of electric force lines emanating from the conductive support of the photosensitive belt, which is grounded, directed to the latent image increases due to the presence of the floating electrodes 2, thereby allowing the attainment of pronounced edge effect, which, in turn, allows production of a copy image of increased density in the case where an original image is a line image.

After developing, there remains residual toner 5*c* which has not been transferred to the belt at the developing region on the surface of the sleeve 1, and the magnet particles 2 retain the charge opposite in polarity to the charge of the toner 5*c*. However, as the sleeve 1 is further driven to rotate, these charges are eliminated by the discharging brush 7. That is, the brush 7 removes the charge from the residual toner 5*c* by contact or coming closer thereto and the charge from the exposed portions of the sleeve 1. Accordingly, the sleeve 1 becomes free of excessive residual charge and is made ready for the next cycle of operation. In this manner, since the unnecessary charge is removed prior to the subsequent operation, the production of undesired phantom images may be well prevented from occurring.

Figure 6:
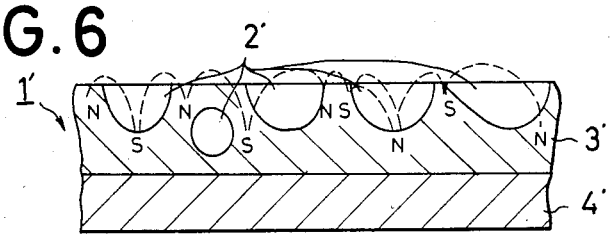
Figure 7:
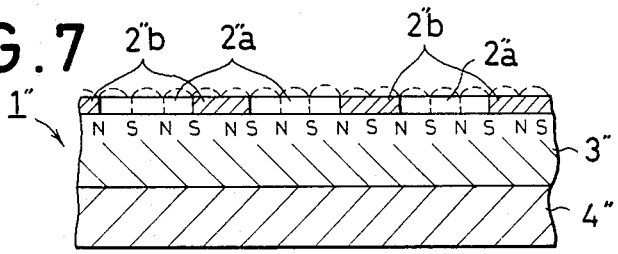

In each of the above-described embodiments, use is made of magnet particles 2 as a means for producing an attractive magnetic field to keep the magnetic toner attracted to the sleeve 1 for transportation. As an alternative, the dielectric layer 3 may comprise non-magnetic particles to aid in forming a desired magnetic field. FIG. 6 shows an embodiment in which a developing sleeve 1' includes an electrically conductive support 4' and a dielectric layer 3' formed on the support 4' from a permanent magnet material with a plurality of electrically conductive, non-magnetic particles 2' embedded in the dielectric layer separated from one another and from the support 4'. Some representative magnetic poles S and N are indicated in FIG. 6; however, it is to be noted that these poles are preferably located closer to the outer surface of the sleeve 1'. FIG. 7 shows another embodiment in which a developing sleeve 1'' includes an electrically conductive support 4'', a dielectric layer 3'' comprised of a permanent magnet material formed on the support 4'' and magnetized alternately in magnetic polarity along the outer surface and non-magnetic electrically conductive islands 2''*a* which are formed on the dielectric layer 3'' as individually isolated by non-magnetic dielectric isolations 2''*b*. Either of these two structures may be advantageously applied to the developing device of FIG. 2.

Figure 8:
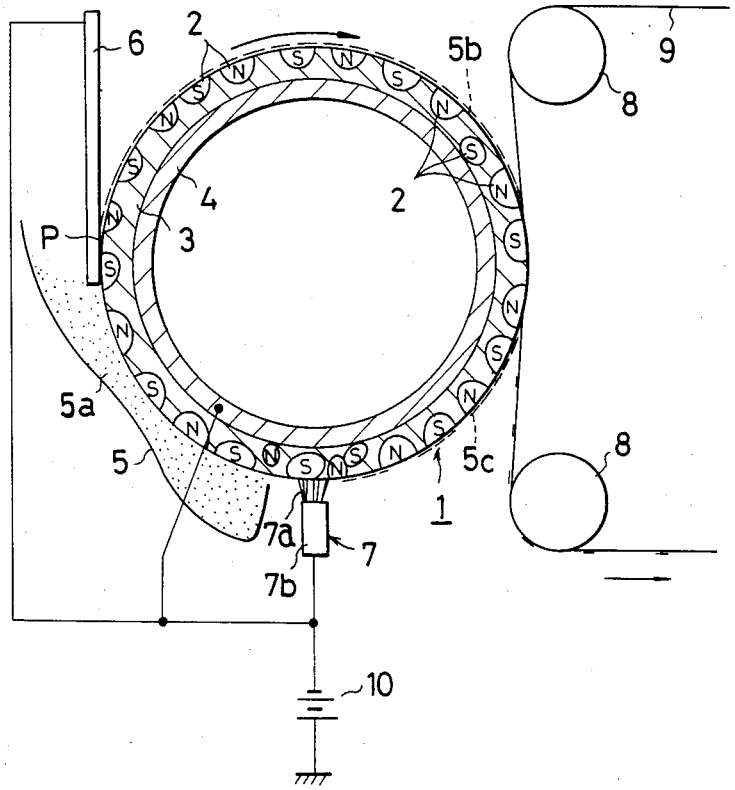
FIG. 8 is a schematic illustration showing another embodiment of the present invention in which the pressure blade is disposed in the counter-arrangement with its free end pointed opposite to the direction of movement of the developing sleeve.

FIG. 8 shows a further embodiment in which the pressure blade 6 is arranged in a counter-arrangement in which the free end of the blade 6 is pointed opposite in direction to the moving direction of the sleeve 1 at the contact therebetween. This arrangement is preferable in that the amount of toner 5*a* to be supplied to the sleeve 1 may be easily controlled by adjusting the length of the projection of the blade 6 beyond the contact line between the sleeve 1 and the blade 6. Similarly with the embodiment shown in FIG. 2, the blade 6 is preferably made of a magnetic material and disposed with its base end pivotally supported to a machine housing and its free end kept in pressure contact with the sleeve as magnetically attracted by the fine magnets 2 provided as embedded in the sleeve 1. It should also be noted as mentioned previously that the sleeve 1 may be pressed against the belt 9 or it may be disposed with its outer peripheral surface spaced apart from the belt 9 over a predetermined gap without direct physical contact therebetween.

While the above provides a full and complete disclosure of the preferred embodiments of the present invention, various modifications, alternate constructions and equivalents may be employed without departing from the true spirit and scope of the invention. Therefore, the above description and illustration should not be construed as limiting the scope of the invention, which is defined by the appended claims.

What is claimed is:

1. A device for developing an electrostatic latent image by applying magnetically attractable toner hereto, comprising:

transporting means for transporting said toner along a predetermined path including a developing region where said latent image is developed, said transporting means including a rotatable supported sleeve whose outer peripheral surface defines a transporting surface on which said toner is carried as magnetically attracted thereto to travel along a circular path defined by the circumference of said sleeve, said sleeve including an electrically conductive, cylindrical support, a dielectric layer formed on the outer peripheral surface of said support, and a plurality of fine magnets comprised of an electrically conductive material and provided as embedded in said dielectric layer as separate from one another and from said support, thereby causing said toner to be magnetically attracted to said transporting surface;

supply means disposed upstream of said developing means with respect to the direction of transportation of said toner for supplying said toner to said transporting means; and toner film forming means disposed between said supply means and said developing region with respect to the direction of transportation of said toner, said toner film forming means including a blade in pressure contact with said transporting means thereby pressing said toner into a thin film of predetermined thickness while having said toner charged triboelectrically to a predetermined polarity.

2. A device of claim 1 wherein said plurality of fine magnets are arranged closer to the outer peripheral surface of said dielectric layer, at least some of them being partly exposed at said outer peripheral surface of said dielectric layer.

3. device of claim 2 wherein the magnetic dipoles of said magnets are directed substantially in parallel with the rotational axis of said sleeve.

4. A device of claim 2 wherein the magnetic dipoles of said magnets are directed along the circumference of said sleeve.

5. A device of claim 2 wherein the magnetic dipoles of said magnets are directed along the radius of said sleeve.

6. A device of claim 1 wherein said plurality of fine magnets are arranged so that at least some are partly exposed at the outer peripheral surface of said dielectric layer and as separated from one another.

7. A device of claim 1 wherein said blade is comprised of a magnetic material and said blade is pivotally supported at its base end with its free end kept in pressure contact with said transporting surface of said sleeve while being magnetically attracted thereto by said magnets.

8. A device of claim 7 further comprising discharging means disposed between said developing region and said supply means with respect to the transporting direction of said toner for removing charge at least from the electrically conductive fine magnets provided in said dielectric layer and exposed at the outer peripheral surface thereof.

9. A device of claim 8 wherein said discharging means includes an electrically conductive brush which is disposed with its tip end lightly in contact with or at a position spaced apart over a predetermined distance from said sleeve.

10. A device of claim 7 wherein said blade is disposed in a forward arrangement in which the free end of said blade is pointed toward the direction of movement of said sleeve at the contact therebetween.

11. A device of claim 7 wherein said blade is disposed in a counter-arrangement in which the free end of said blade is pointed opposite to the direction of movement of said sleeve at the contact therebetween.

12. A device of claim 7 further, comprising means for applying a predetermined electrical potential to said blade and said cylindrical support of said sleeve.

13. A device for developing an electrostatic latent image by applying magnetically attractable toner thereto, comprising:

transporting means for transporting said toner along a predetermined path including a developing region where said latent image is developed, said transporting means including a rotatably supported sleeve whose outer peripheral surface defines a transporting surface on which said toner is carried as magnetically attracted thereto to travel along a circular path defined by the circumference of said sleeve, said sleeve including an electrically conductive, cylindrical support and a dielectric layer formed on the outer peripheral surface of said support, said dielectric layer being comprised of a magnetic material and magnetized alternately in magnetic polarity along its outer peripheral surface;

supply means disposed upstream of said developing means with respect to the direction of transportation of said toner for supplying said toner to said transporting means; and toner film forming means disposed between said supply means and said developing region with respect to the direction of transportation of said toner, said toner film forming means including a blade in pressure contact with said transporting means thereby pressing said toner into a thin film of predetermined thickness whill having said toner charged triboelectrically to a predetermined polarity.

14. A device of claim 13 wherein said sleeve is provided with a plurality of non-magnetic electrically conductive islands formed on the outer peripheral surface of said dielectric layer as isolated form one another.

15. A device of claim 14 wherein said sleeve is further provided with dielectric isolations provided between said electrically conductive islands as formed on the outer peripheral surface of said dielectric layer.

* * * * *